US007559436B2

(12) United States Patent
Bieger

(10) Patent No.: US 7,559,436 B2
(45) Date of Patent: Jul. 14, 2009

(54) SMALL ITEM DISPENSER

(75) Inventor: Walter I. Bieger, St. Paul, MN (US)

(73) Assignee: Webb Candy, Inc., Rosemount, MN (US)

( * ) Notice: Subject to any disclaimer, the term of this patent is extended or adjusted under 35 U.S.C. 154(b) by 45 days.

(21) Appl. No.: 11/136,298

(22) Filed: May 24, 2005

(65) Prior Publication Data

US 2006/0266764 A1 Nov. 30, 2006

(51) Int. Cl.
*G07F 11/16* (2006.01)

(52) U.S. Cl. ..... 221/256; 221/266; 221/257

(58) Field of Classification Search ..... 221/256, 221/246, 257, 265

See application file for complete search history.

(56) References Cited

U.S. PATENT DOCUMENTS

| | | | | |
|---|---|---|---|---|
| 2,149,445 | A * | 3/1939 | Kreiten | 221/248 |
| 2,177,863 | A * | 10/1939 | Cadden et al. | 221/246 |
| 2,627,973 | A * | 2/1953 | Sines | 221/266 |
| 2,692,698 | A | 10/1954 | Waterman | |
| D176,730 | S | 1/1956 | Olsen | |
| 3,191,803 | A | 6/1965 | Hamilton | |
| 3,788,517 | A * | 1/1974 | Eannarino et al. | 221/264 |
| 3,968,902 | A | 7/1976 | Bachmann | |
| D249,868 | S | 10/1978 | Russert | |
| D249,933 | S | 10/1978 | Stern | |
| D252,558 | S | 8/1979 | Beck | |
| 4,194,632 | A | 3/1980 | Dutcher | |
| 4,230,236 | A | 10/1980 | Boulter | |
| 4,230,237 | A | 10/1980 | de Wit | |
| 4,354,619 | A | 10/1982 | Wippermann et al. | |
| 4,402,425 | A | 9/1983 | von Shuckmann | |
| 4,418,838 | A | 12/1983 | Gallina | |
| 4,428,502 | A * | 1/1984 | Veltri | 221/266 |
| 4,854,478 | A | 8/1989 | Gyimothy | |
| 5,018,644 | A | 5/1991 | Hackmann et al. | |
| 5,366,113 | A | 11/1994 | Kim et al. | |
| 5,513,774 | A | 5/1996 | Dominquez | |
| 5,657,901 | A | 8/1997 | Farside | |
| D397,033 | S | 8/1998 | Puglisi | |
| D406,760 | S | 3/1999 | Puglisi | |
| 5,897,025 | A | 4/1999 | Flewitt et al. | |
| 5,931,302 | A | 8/1999 | Isaacs et al. | |
| 5,967,374 | A | 10/1999 | Baker | |
| 6,142,337 | A | 11/2000 | Schreckenberg et al. | |

(Continued)

OTHER PUBLICATIONS

Jayline Catalog, Accomplish-Mints, Catalog p. 5, date unknown.

(Continued)

*Primary Examiner*—Gene Crawford
*Assistant Examiner*—Timothy R Waggoner
(74) *Attorney, Agent, or Firm*—Merchant & Gould P.C.

(57) ABSTRACT

A dispenser for dispensing small items such as pieces of candy is disclosed herein. The dispenser includes a container having a first major side, a second major side, and a storage volume positioned between the first and second major sides. The dispenser includes a dispensing opening defined through the first major side. A dispensing member for carrying the items from the storage volume to the dispensing opening carries the items along a path of travel aligned along a plane, the dispensing opening having an axis aligned in a direction generally perpendicular to the plane.

2 Claims, 5 Drawing Sheets

U.S. PATENT DOCUMENTS

| | | | | |
|---|---|---|---|---|
| D437,787 | S | 2/2001 | Ho | |
| 6,220,480 | B1 | 4/2001 | Stankus | |
| D459,217 | S | 6/2002 | Puglisi | |
| 6,530,505 | B1 | 3/2003 | Barnes et al. | |
| D472,802 | S | 4/2003 | Barnes et al. | |
| 6,561,379 | B1 * | 5/2003 | Goh | 221/263 |
| D482,609 | S | 11/2003 | Weinstock | |
| D496,271 | S | 9/2004 | Hoeltgen | |
| D523,351 | S * | 6/2006 | Bieger | D9/730 |
| 2004/0004083 | A1 | 1/2004 | Grant | |
| 2004/0074915 | A1 | 4/2004 | Hallin | |
| 2004/0094566 | A1 * | 5/2004 | Renaud | 221/266 |

OTHER PUBLICATIONS

Jayline Catalog, Slim Mints™ 9715, 9725, 9765, Catalog pp. 6 and 7, date unknown.

Jayline-Products Details, Slim Mints 9700, http://www.jaylineworld.com/Client Product Details/, date printed May 12, 2005.

* cited by examiner

FIG. 8
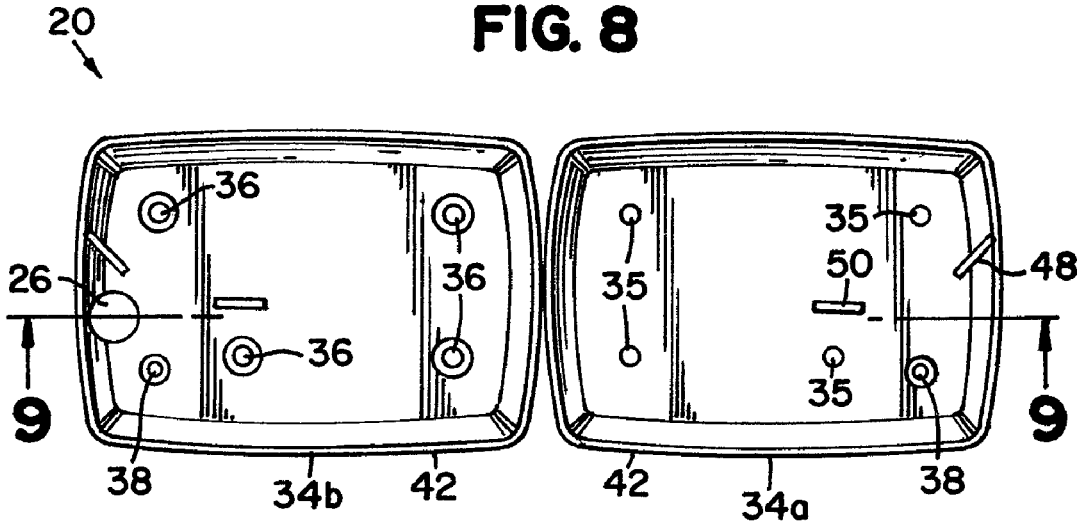
FIG. 9
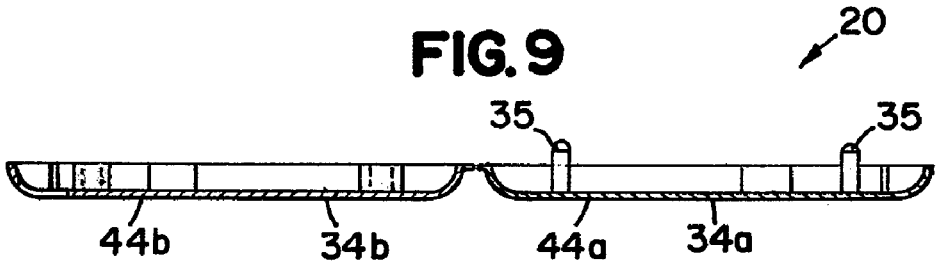
FIG. 10
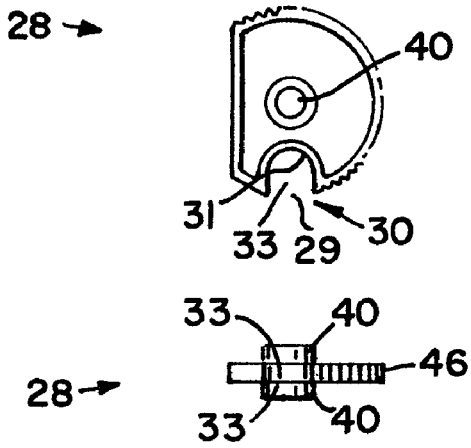
FIG. 11

FIG. 12
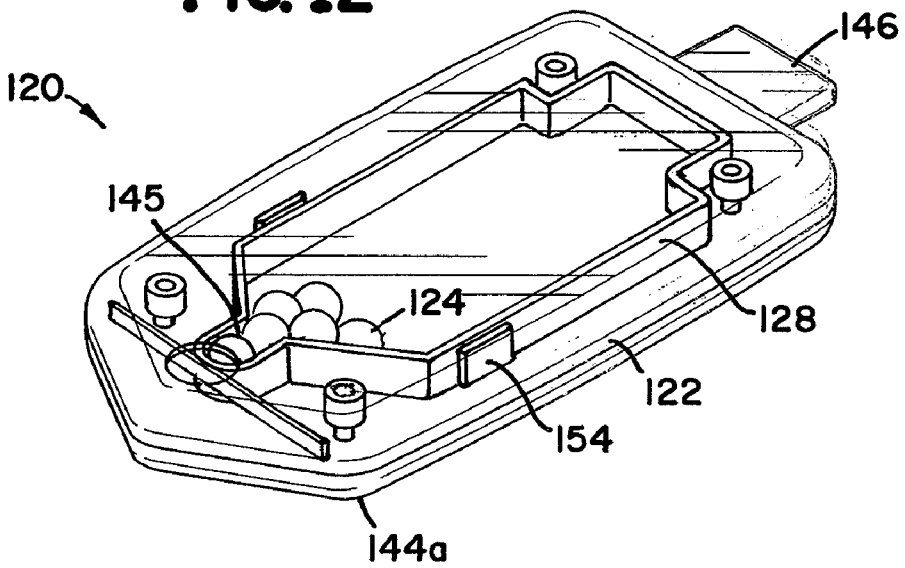
FIG. 13
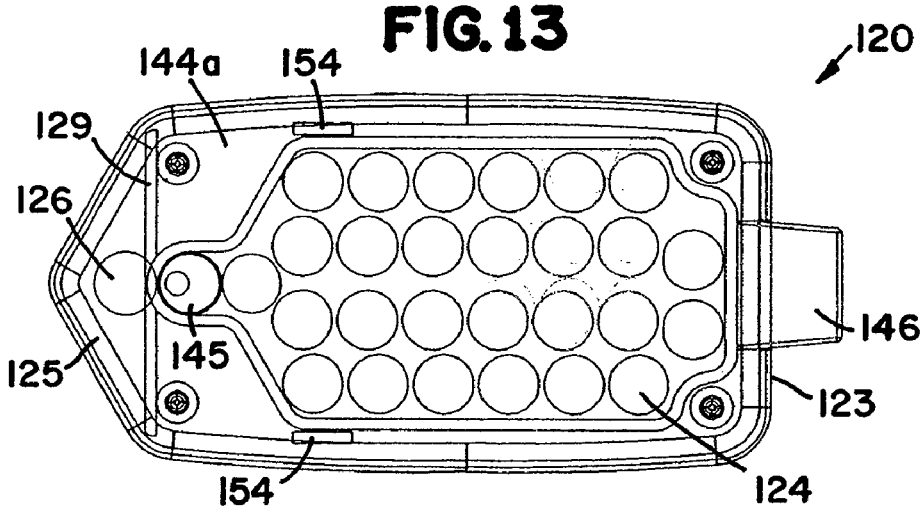
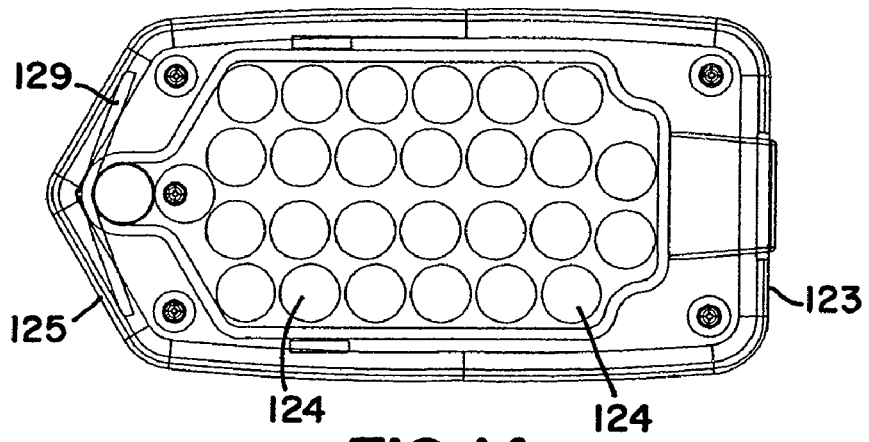
FIG. 14

SMALL ITEM DISPENSER

TECHNICAL FIELD

The present invention relates generally to dispensers. More particularly, the present invention relates to dispensers for dispensing small items such as pieces of candy.

BACKGROUND

Containers for storing and dispensing small items such as tablets or pieces of candy are well known. Some examples of small item dispensers may include a removable screw top, a peelable seal, a slidable cover, or a snap-fit cap or opening. Once these closures are opened, the items within the containers may be freely poured from the container. One problem often encountered with the dispensers found in the art is that their designs do not allow the items to be individually dispensed from the container. A person wanting one tablet or a piece of candy often has a difficult time controlling the amount of items dispensed from the container and usually has to resort to discarding the unwanted pieces.

SUMMARY

One aspect of the present disclosure relates to a dispenser adapted for easily dispensing small items such as pieces of candy. In one example embodiment, the dispenser includes a container for holding the items desired to be dispensed, an opening through a major side of the container for dispensing items from the container, and a dispensing member controlling the discharge of items from the dispensing opening.

Examples representative of a variety of inventive aspects are set forth in the description that follows. The inventive aspects relate to individual features as well as combinations of features. It is to be understood that both the forgoing general description and the following detailed description merely provide examples of how the inventive aspects may be put into practice, and are not intended to limit the broad spirit and scope of the inventive aspects.

BRIEF DESCRIPTION OF THE DRAWINGS

FIG. 8 is a plan view showing 2 half-shells of the dispenser of FIG. 1;

FIG. 9 is a cross sectional view taken along section line 9-9 of FIG. 8;

FIG. 10 is a plan view of a dispensing member used by the dispenser of FIG. 1;

FIG. 11 is an elevational view of the dispensing member of FIG. 10;

FIG. 12 is a perspective view of a second embodiment of a dispenser in accordance with the principles of the present disclosure;

FIG. 13 is a front view of the dispenser of FIG. 12 with a dispensing member shown in a first position;

FIG. 14 is a front view of the dispenser of FIG. 12 with the dispensing member shown in a second position;

DETAILED DESCRIPTION

Figure 1:
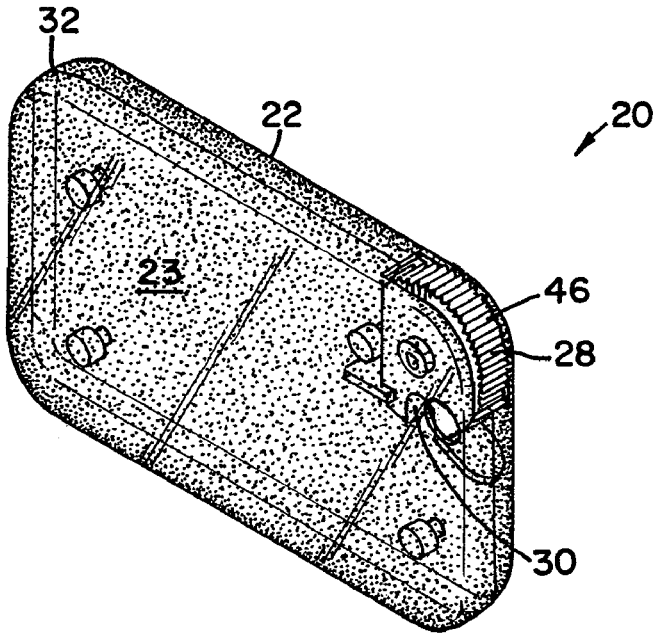
FIG. 1 is a perspective view of a dispenser in accordance with the principles of the present disclosure.

FIG. 1 illustrates a dispenser 20 in accordance with the principles of the present disclosure. The dispenser 20 includes a container 22 including an interior storage volume 23 for holding a plurality of items 24. The container 22 includes an opening 26 (i.e., a dispensing opening) for dispensing the items 24 from the container 22. The dispenser 20 also includes a dispensing member 28 for carrying the items 24 from the storage volume 23 of the container 22 to the opening 26. The dispensing member 28 includes a pocket 30 for receiving the items 24. The dispensing member 28 is movable between a first position (shown in FIG. 2) and a second position (shown in FIG. 3). When the dispensing member 28 is in the position of FIG. 2, the pocket 30 is oriented to receive items 24 from the storage volume 23 of the container 22. When the dispensing member 28 is in the position of FIG. 3, the pocket 30 aligns with the opening 26 such that items 24 within the pocket 30 can be dispensed through the opening 26. By moving the pocket 30 back and forth between the positions of FIGS. 2 and 3, multiple items 24 can be removed from the storage volume 23 of the container 22 and dispensed through the opening 26.

It will be appreciated that a variety of different types of items can be dispensed from the dispenser 20. Preferred items include pieces of candy. In one embodiment, the pieces of a candy can include pieces of hard candy. In a preferred embodiment, the items can include liquid filled (e.g., mint filled) candy. In one example embodiment, the items can include balls or spheres of candy including outer gelatin coatings and an inner liquid candy filling (e.g., a mint filling).

Referring to FIGS. 1-7, the container 22 is depicted as being a relatively thin generally rectangular envelope having rounded corners 32. The dispensing member 28 is mounted adjacent one of the corners 32. As shown in FIGS. 8 and 9, the container 22 is defined by two generally rectangular half-shells 34*a*, 34*b*. Half-shell 34*a* includes four mounting posts 35 while half-shell 34*b* includes mounting post receivers 36. The half-shells 34*a*, 34*b* also include pivot posts 38 that fit within pivot bearings 40 of the dispensing member 28. To assemble the dispenser 20, the dispensing member 28 is mounted to one of the half-shells 34*a*, 34*b* (e.g., by inserting one of the pivot bearings 40 over the corresponding pivot post 38 of the half-shell 34*a*, 34*b* to which the dispensing member 28 is mounted). While the half-shells 34*a*, 34*b* are separated from one another, the items 24 desired to be dispensed can be loaded into the container 22. After loading the items 24 into the container, the two half-shells 34*a*, 34*b* are mounted together with the mounting posts 35 of the half-shell 34*a* received in the mounting post receivers 36 of the half-shell 34*b*. Also, the dispensing member 28 is captured between the half-shells 34*a*, 34*b* with the pivot bearings 40 positioned around the pivot posts 38. As assembled, outer edges 42 of the half-shells 34*a*, 34*b* contact one another to define a generally rectangular perimeter of the container 22.

Referring still to FIGS. 8 and 9, half-shell 34*a* includes a major side 44*a* and the half-shell 34*b* includes a major side 44*b*. When the container 22 is assembled (as shown at FIGS.

1-7), the major sides 44*a,* 44*b* oppose and are generally parallel to one another. In one embodiment, a relatively thin spacing S is provided between the major sides 44*a,* 44*b.* In one example embodiment, the spacing S is sized such that only a single layer of items 24 can be provided within the container 22. For example, in one embodiment, the spacing S is less than 2 times the diameter of the items (e.g., spheres) held within the container 22. In a preferred embodiment, the spacing S is only slightly larger than the diameter of the items held within the container 22. As defined herein, the term "major side" is a side having a larger surface area than the other sides of the container.

Figure 3:
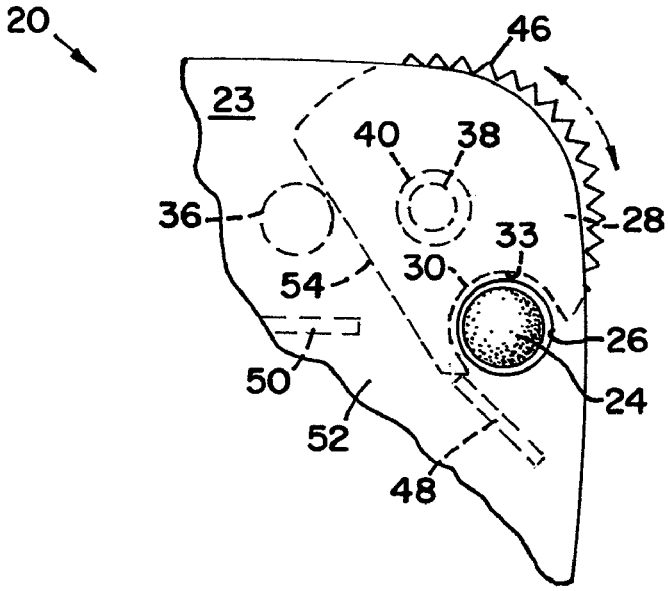
FIG. 3 is a partial blown-up view of the front view of the dispenser of FIG. 1 with the dispensing member in a second position.
Figure 4:
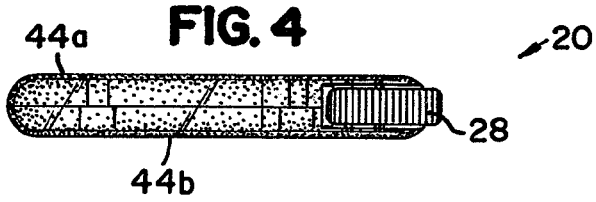
FIG. 4 is a top view of the dispenser of FIG. 1.
Figure 5:
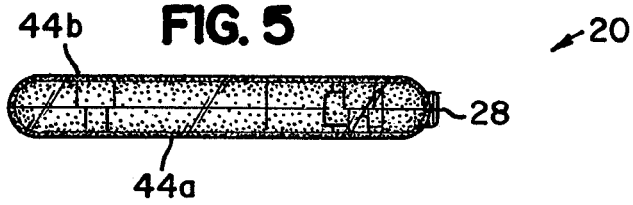
FIG. 5 is a bottom view of the dispenser of FIG. 1.
Figure 2:
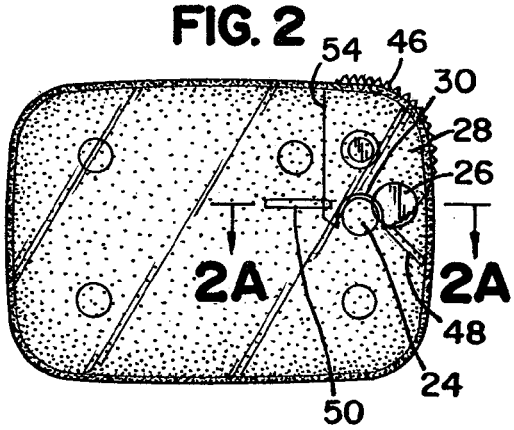
FIG. 2 is a front view of the dispenser of FIG. 1 with a dispensing member shown in a first position.

Referring now to FIGS. 2 and 3, the dispensing member 28 includes a knurled outer surface 46 having a circular curvature generally centered about the pivot bearings 40 of the dispensing member 28. The knurled outer surface 46 projects outwardly beyond the outer perimeter of the container 28 to provide ready finger access for pivoting the dispensing member 28. In the depicted embodiment, the pocket 30 of the dispensing member 28 is sized to hold only a single one of the items 24 at a time. Thus, the dispensing member 28 allows the items 24 to be individually dispensed from the container 22. The dispensing member 28 can also be referred to as a pivot member, a rotation member, a wheel, a dial, a carrier, or like terms.

Referring to FIGS. 10 and 11, the pocket 30 of the dispensing member 28 includes an open end 29 positioned opposite from a closed end 31. The pocket 30 also includes open sides 33 that extend between the open end 29 and the closed end 31.

Referring still to FIGS. 2 and 3, the container 22 also includes funnel members 48 and 50 positioned within the container 22. A gap 52 is defined between the funnel members 48, 50. When the dispensing member 28 is in the position of FIG. 2, the open end 29 of the pocket 30 aligns with the gap 52 such that an item 24 within the container 22 can be readily funneled through the gap 52 into the pocket 30 through the open end 29. When the dispensing member 28 is in the position of FIG. 3, a flat side 54 of the dispensing member 28 blocks the gap 52 to prevent items 24 from flowing through the gap 52, and one of the open sides 33 of the pocket 30 aligns with the dispensing opening 26 such that the item 24 within the pocket can exit the pocket through the open side 33 to be dispensed through the opening 26.

Figure 2A:
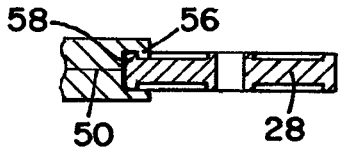
FIG. 2*a* is a cross-sectional view taken along section line 2*a*-2*a* of FIG. 2.
Figure 6:
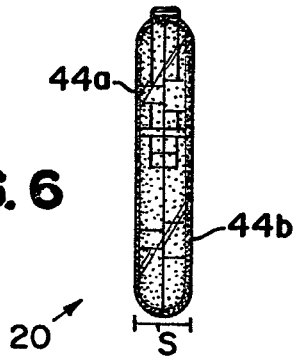
FIG. 6 is a left end view of the dispenser of FIG. 1.
Figure 7:
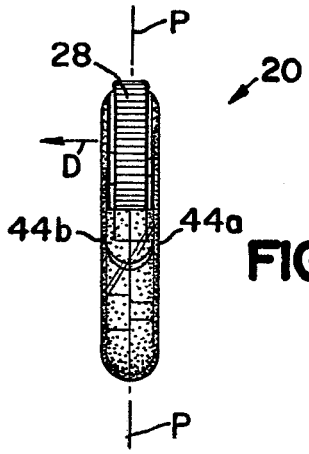
FIG. 7 is a right end view of the dispenser of FIG. 1.

The dispenser 20 preferably includes positive stops for stopping the dispensing member 28 in the positions of FIGS. 2 and 3. For example, when the dispensing member 28 is in the position of FIG. 3, the flat side 54 of the dispensing member 28 engages one of the mounting post receivers 36 such that the mounting post receiver 36 functions as a positive stop. When the dispensing member 28 is in the position of FIG. 2, the flat side 54 engages the funnel member 50 such that the funnel member 50 functions as a positive stop. As shown at FIG. 2*a,* the funnel member 50 also includes a flexible latch 56 that engages a peripheral lip 58 of the dispensing member 28 to hold the dispensing member 28 in the position of FIG. 2. When a user moves the dispensing member 28 from the position of FIG. 2 toward the position of FIG. 3, the latch 56 flexes to allow clearance of the lip 58 and movement of the dispensing member 28.

As shown at FIG. 8, the opening 26 is defined through the major side 44*b* of the half-shell 34*b.* When an item 24 is carried by the dispensing member 28 from the position of FIG. 2 to the position of FIG. 3, the item 24 moves along a path of travel aligned along a plane P (see FIG. 7) that is generally parallel to the major sides 44*a,* 44*b.* When the item 24 is dispensed through the opening 26, the item 24 travels through the major side 44*b* and the open side 33 of the pocket 30 in a direction D that is generally perpendicular relative to the plane P.

FIG. 12 illustrates a second embodiment of a dispenser 120 in accordance with the principles of the present disclosure. The dispenser 120 includes features similar to the dispenser 20 shown in FIGS. 1-11, except that dispenser 120 includes a dispensing member 128 that is configured to slide, rather than rotate, within a container 122. The dispensing member 128 is slidably movable between a first position (shown in FIG. 13) and a second position (shown in FIG. 14).

Figure 15:
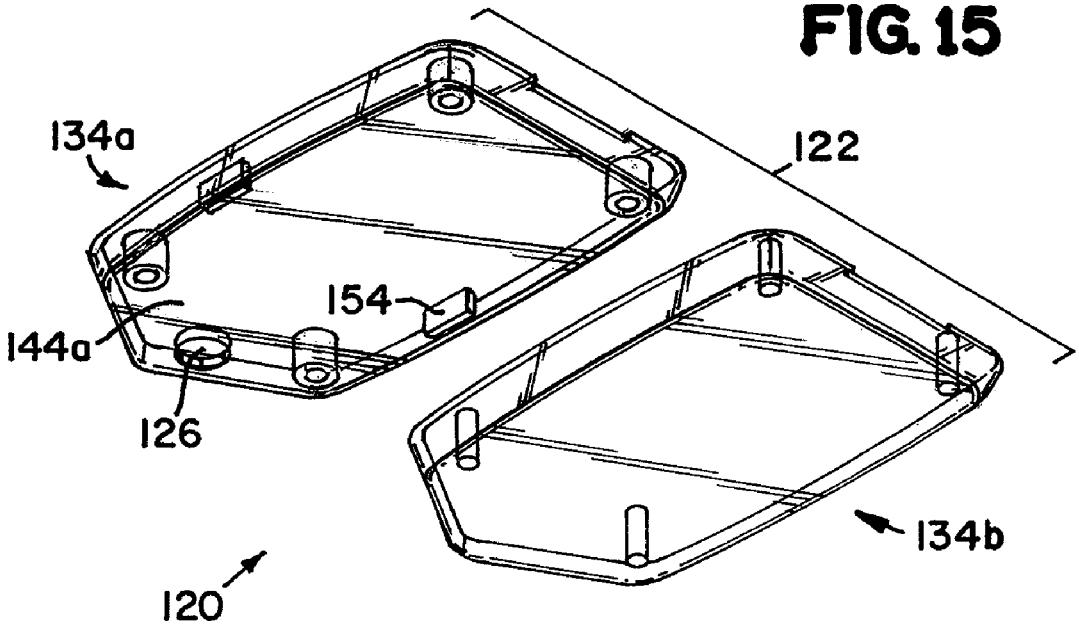
FIG. 15 is a perspective view showing 2 half-shells of the dispenser of FIG. 12.

Referring to FIGS. 12-15, the container 122 of the dispenser 120 is generally rectangular with a flat first end 123 and a slightly V-shaped second end 125. As in the dispenser 20, the dispenser 120 includes two half-shells 134*a,* 134*b* that are press-fit together to form the container 122. After being filled with items 124, the dispensing member 128 is captured between the two half-shells 134*a,* 134*b.* As depicted in FIG. 15, one of the half-shells may include guides 154 for slidably guiding the dispensing member 128 within the container 122. A dispensing opening 126 is defined on a major side 144*a* of the half-shell 134*a.* The dispensing opening 126 is located adjacent the V-shaped second end 125 of the container 122.

Figure 16:
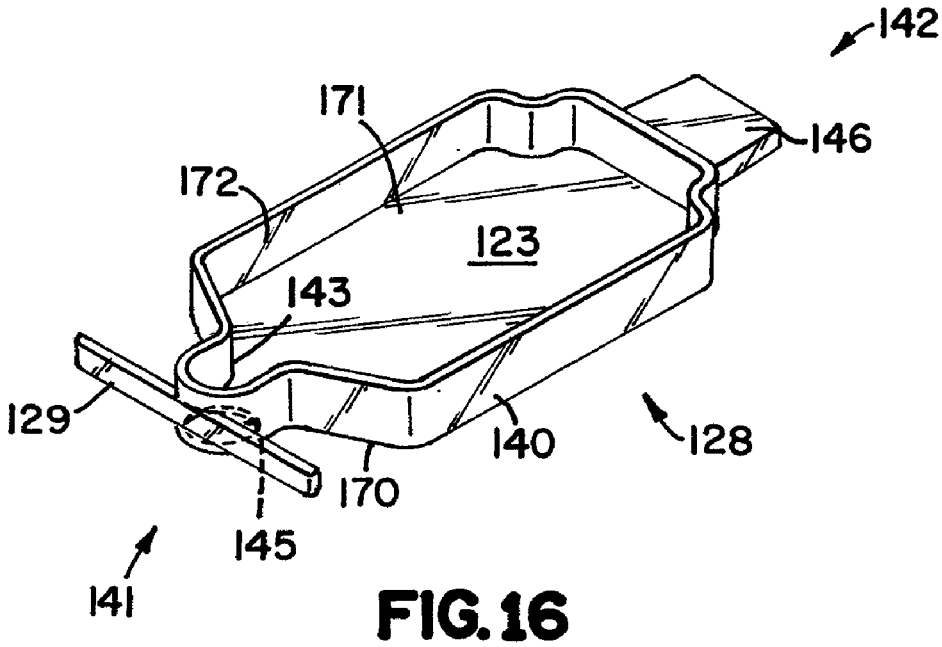
FIG. 16 is a perspective view of a dispensing member used by the dispenser of FIG. 12.

Referring to FIG. 16, the dispensing member 128, shown in isolation, includes a generally rectangular housing 140 with a first end 141 and a second end 142. The housing 140 includes a closed first side 170, an open second side 171, and a peripheral sidewall 172 extending between the closed side 170 and the open side 171. The peripheral sidewall 172 along with the closed first side 170 defines an interior storage volume 123 for holding the plurality of items 124. The dispensing member 128 can also be referred to as a drawer. The housing 140 of the dispensing member 128 defines a pocket 143 at the first end 141 for receiving the items 124. An opening 145 is defined within the pocket 143 for dispensing the items 124. At the second end 142 of the housing 140 is provided a push-tab 146 for slidably moving the dispensing member within the container 122. The two half-shells 134*a* and 134*b* of the container 122 cooperatively form an opening at the first end 123 for accommodating the push-tab 146.

The dispensing member 128 defines biasing members 129 adjacent the first end 141 of the housing 140 for biasing the dispensing member 128 away from the dispensing position of FIG. 14. When the dispensing member 128 is in the position of FIG. 13, the pocket 143 is not aligned with the opening 126 of the container. When the dispensing member 128 is slidably pushed to the position of FIG. 14 via the push-tab 146, the opening 145 of the drawer 128 aligns with the opening 126 of the container 122 such that items 124 within the pocket 143 can be dispensed through the opening 126. The biasing members 129 bend against the V-shaped second end 125 of the container 122 when the dispensing member 128 is brought to position of FIG. 14. When the push-tab 146 is released, the biasing members 129 flex back against the V-shaped second end 125 to slidably move the drawer 128 back to the position of FIG. 14.

The above specification provides examples of how certain inventive aspects may be put into practice. It will be appreciated that the inventive aspects can be practiced in other ways than those specifically shown and described herein without departing from the spirit and scope of the inventive aspects.

I claim:

1. A dispenser comprising:

a container including a first major side, a second major side parallel to the first major side, and a storage volume positioned between the first and second major sides, the container including a dispensing opening defined through the first major side, the dispensing opening fully enclosed by the first major side; and a dispensing member that is rotatably disposed with respect to the container, the dispensing member being rotatable for carrying items from the storage volume to the dispensing opening, the dispensing member configured to carry the items along a path of travel aligned along a plane, the dispensing opening having an axis aligned in a direction generally perpendicular to the plane, the dispensing member including a pocket for receiving items from the storage volume, wherein the dispensing member is configured to dispense the items out of the pocket in a direction generally perpendicular to the plane when the pocket aligns with the dispensing opening, the dispensing member being positioned at a corner of the container, wherein the dispensing member includes portions protruding out of both sides that intersect to define the corner of the container at which the dispensing member is positioned, the portions of the dispensing member protruding out of the container defining a continuous gripping surface without any pockets thereon, wherein the pocket of the dispensing member is defined at an end of the continuous gripping surface, the dispensing member being rotatable with respect to the container between only a first position and a second position, the first position being an item receiving position wherein the item is received into the pocket and the second position being an item dispensing position wherein the item is dispensed from the container, wherein the dispensing member is rotatable an angle of less than 90 degrees to move between the first position and the second position, wherein the container includes positive stops for stopping the dispensing member at the first and second positions.

2. The dispenser of claim 1, wherein the container includes a first half-shell defining the first major side and a second half-shell defining the second major side that is parallel to the first major side, wherein the first and second half-shells are mounted together to assemble the container.

* * * * *